US005925273A

United States Patent [19]

Sherrill

[11] Patent Number: 5,925,273

[45] Date of Patent: Jul. 20, 1999

[54] ELECTRIC MULTI-STAGE HEATER ASSEMBLY

[75] Inventor: Jimmy L. Sherrill, Cookeville, Tenn.

[73] Assignee: Tutco, Inc., Wayne, Pa.

[21] Appl. No.: 08/954,100

[22] Filed: Oct. 20, 1997

[51] Int. Cl.[6] ..... H05B 3/02

[52] U.S. Cl. ..... 219/478; 219/480; 219/476; 219/477; 219/532; 219/537

[58] Field of Search ..... 392/350; 219/478, 219/480, 476, 477, 537, 532; 338/304, 305, 319, 320, 299

[56] References Cited

U.S. PATENT DOCUMENTS

| | | | |
|---|---|---|---|
| 427,574 | 5/1890 | Howard | 392/350 |
| 1,165,451 | 12/1915 | Ruckle | 219/532 |
| 1,313,258 | 8/1919 | Carmean et al. | 219/532 |
| 2,242,630 | 5/1941 | Steingruber | 392/350 |
| 3,164,715 | 1/1965 | Cotts | 392/350 |
| 3,622,752 | 11/1971 | Brasch | 392/350 |
| 3,691,348 | 9/1972 | Kunz | 219/532 |
| 3,846,619 | 11/1974 | Wightsman et al. | 219/532 |
| 3,883,721 | 5/1975 | Paulson et al. | 219/532 |
| 3,890,487 | 6/1975 | Wightman et al. | 219/532 |
| 4,250,399 | 2/1981 | King . | |
| 4,458,141 | 7/1984 | Howard et al. . | |
| 4,481,411 | 11/1984 | Roth . | |
| 4,617,547 | 10/1986 | Howard et al. . | |
| 4,857,707 | 8/1989 | Dall . | |
| 5,134,270 | 7/1992 | Bragg et al. | 219/532 |
| 5,324,919 | 6/1994 | Howard et al. . | |
| 5,329,098 | 7/1994 | Howard et al. . | |
| 5,578,232 | 11/1996 | Engelke | 219/532 |

*Primary Examiner*—Teresa Walberg
*Assistant Examiner*—Vinod D Patel
*Attorney, Agent, or Firm*—Patton Boogs LLP

[57] ABSTRACT

An electric multi-stage heater assembly that provides multi-level heating using a plurality of separately controllable heating elements within a housing that is readily interchangeable with standard single-stage heater housings that can be controlled by conventional power switching circuits. The multi-stage heater assembly of this invention has each electric heater element straddling a support member with a portion of the heater element extending from one side to the other to maintain the electrical continuity of the element. The support member has a plurality of cut-outs that provide space for routing the cross over portion of the heater element and sufficient clearance to accommodate the inevitable droop associated with heat cycling electric resistive heater elements. The support member is equipped with a plurality of insulators which support and electrically insulate the heater element. The insulators are arranged to cooperatively rotate within the support member to minimize sagging of the heater elements.

12 Claims, 3 Drawing Sheets

ELECTRIC MULTI-STAGE HEATER ASSEMBLY

FIELD OF THE INVENTION

The invention relates to the art of electric heaters, and in particular the art of electric heater assemblies using coiled resistive electric heater elements. More particularly, the invention relates to a heater assembly comprising a multi-stage electric heater.

BACKGROUND OF THE INVENTION

Electric heater assemblies wherein a support and mounting assembly supports a plurality of insulators which in turn support a coiled resistive electric heater element are shown in U.S. Pat. Nos. 5,329,098 (Howard et al.), 5,324,919 (Howard et al.) and 4,617,547 (Howard et al.). In these patents, there are several types of heater support and mounting assemblies shown supporting an electrically continuous heater element, referred to hereinafter as a single-stage heater. The single-stage heater assembly in U.S. Pat. Nos. 5,329,098 and 5,324,919, which are hereby incorporated by reference, show each end of the heater element extending to a terminal block with two terminals mounted on a side wall toward one end of the housing. Generally, these single-stage heaters comprise a support element, for holding and supporting the insulators which in turn support the heater element within a housing. The housing is generally a continuous U-shaped sheet of material designed to be inserted into a specifically sized open portion of an air duct, for instance, in an appliance such as an electric clothes dryer.

The compact design of appliances where heaters of this type are typically employed limits the amount of space available for insertion of an electric heater assembly. In addition, the appliance manufacturers typically offer several models of any particular appliance which incorporate a variety of different options. The various models are ideally designed to simplify manufacturing by utilizing interchangeable parts, which provide different features, that are assembled using the same equipment and tooling. It has long been recognized that the incorporation of a heater assembly having an ability to vary the heat output and/or provide better heating characteristics into an appliance would enable the appliance manufacturer to offer all or some models of an appliance with additional features making them more marketable. However, this new feature would not be valuable to the appliance manufacturer unless the new heater assembly was compatible with the standard single-stage heater assembly such that it could be readily installed using the same equipment and tooling on appliance models designed to accommodate the standard heater assembly.

Other means of controlling heat output by varying the electric power to the standard single-stage heater assemblies have been attempted but they all involved complex control circuitry and/or other heat producing elements, such as rheostats. These were considered impractical or otherwise undesirable because they were either too costly or involved additional design measures to address the additional heat generated. Therefore, there is a need for a heater assembly that provides multi-level heating within a housing that is readily interchangeable with standard single-stage heater housings that can be controlled by conventional power switching circuits.

SUMMARY OF THE INVENTION

The multi-stage heater assembly of the present invention provides separately controllable electric heater elements in a housing that is readily interchangeable with a conventional single-stage heater element housing. The multi-stage heater assembly of this invention has each electric heater element straddling a support member with a portion of the heater element extending from one side to the other to maintain the electrical continuity of the element. The support member has a plurality of cut-outs that provide space for routing the extended portion of the heater element and sufficient clearance to accommodate the inevitable droop associated with heat cycling of electric resistive heater elements. The support member is equipped with a plurality of insulators which electrically insulate the heater element. These insulators are arranged to cooperatively rotate within the support member to minimize sagging of the heater elements. Each of the heater elements receives electric power through a common terminal block. The heat output of the heater assembly is controlled by selectively switching electric power to one or more of the heater elements.

DETAILED DESCRIPTION OF THE INVENTION

Figure 1:
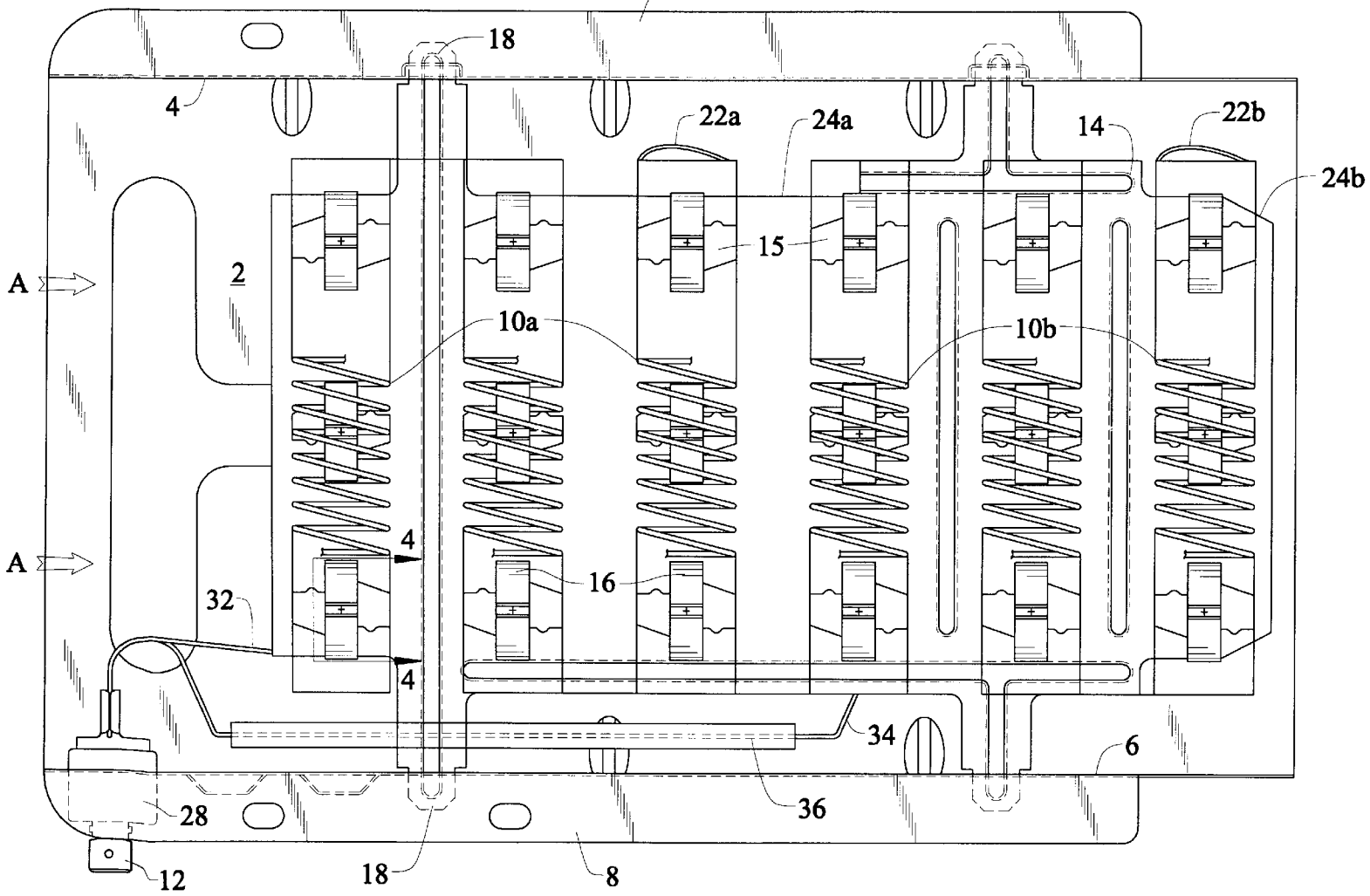
FIG. 1 is a plan view of an electric heater assembly in accordance with a preferred embodiment of the invention.

Before the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

Figure 2:
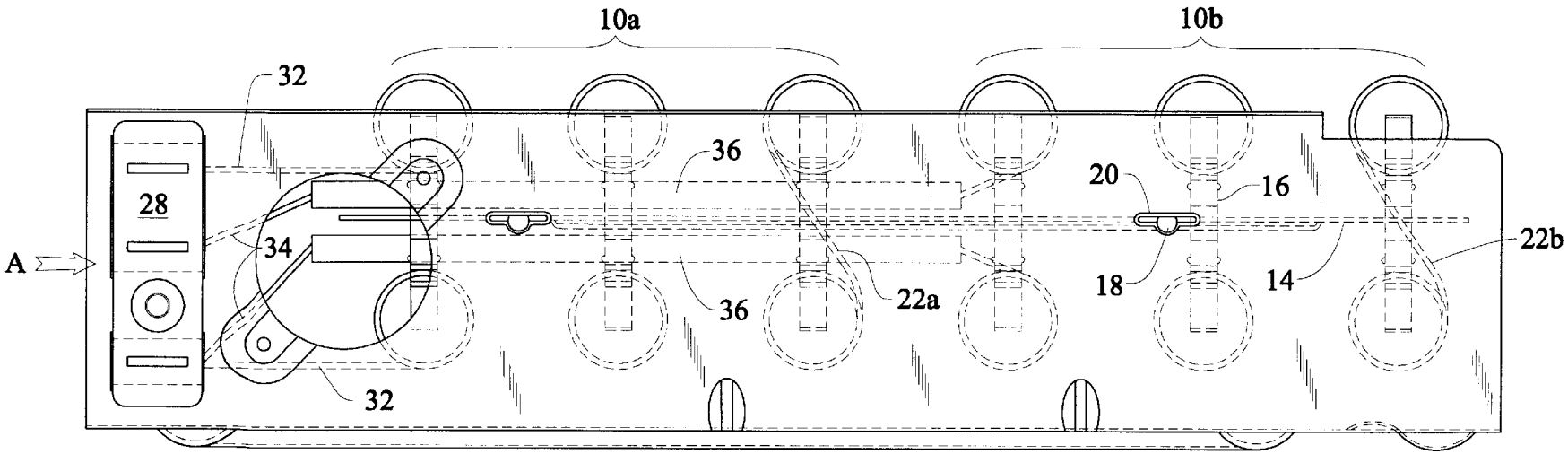
FIG. 2 is a side view of the assembly shown in FIG. 1.
Figure 3:
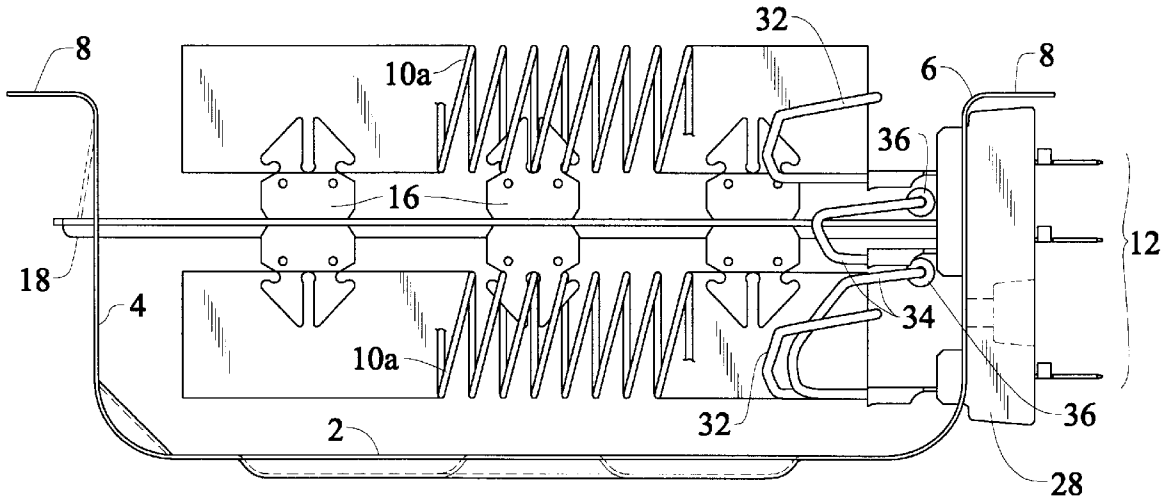
FIG. 3 is an end view of the assembly shown in FIG. 1.

FIGS. 1–3 depict an electric heater assembly in accordance with a preferred embodiment of the invention designed to be attached to a clothes dryer (not shown). The heater assembly in accordance with the invention may, of course, be designed for use with other appliances. The heater assembly includes a housing formed by a bottom wall 2 and opposed sidewalls 4 and 6. Each of the sidewalls includes a tab 8 at its upper edge for facilitating attachment of the housing to the frame of the clothes dryer. The tab is shown as extending outward, but may be of various shapes, depending on the particulars of the intended application of the heater assembly.

The heater assembly shown in the FIGURES has two electric heater elements 10(*a*&*b*) for heating air flowing through the housing, for instance, in a clothes dryer. The coils are supplied with electricity through terminals 12. Although, many orientations are possible, the coil is, preferably, arranged on the support element within the housing so that it is oriented perpendicular to the direction of air flow A through the housing.

The electric heater elements are supported within the channel by a metal plate 14, which in turn supports a series of support insulators 16, which are known in the art. The plate 14 has projections 18, which extend through slots 20, shown in FIG. 2, in the sidewalls 4 and 6 to support the plate, but other attaching arrangements, such as welding, riveting, or the like may be used. The sidewalls are preferably capable of being separated slightly during assembly to accommodate the projections and then springing back to their original position engaging and maintaining the projections 18 within the slots 20 in the sidewalls.

Each of the electric heater elements 10(*a*&*b*) are arranged into a series of electrically continuous coils which are mounted on the plate 14 in a spaced-apart substantially parallel arrangement. Each heater element extends to both sides of the plate. As best shown in FIG. 2, each heater element 10(*a*&*b*) is preferably arranged substantially equally and oppositely on both sides of the plate 14. A cross over portion 22(*a*&*b*) of each heater element extends from a coil mounted on one side around the plate 14 within an area bounded by the housing sidewall 4, preferably not containing the terminal block, and an edge of the plate. The plate 14 has several cutout portions 24(*a*&*b*), shown in FIG. 1, to provide adequate clearance for the cross over portion 22 (*a*&*b*) and the anticipated drooping or sagging movement of such portions.

The two heater elements 10(*a*&*b*) are arranged on the plate 14 so that they are capable of heating air on both sides of the plate. Thus, when only one of the elements is energized, air on both sides of the plate is still being heated. With respect to the direction of air flow A, the first heater element 10*a*, with coil sections mounted on both sides, is positioned upstream of the similarly arranged second heater element 10*b*.

Electricity is supplied to this heater assembly through an electric terminal block 28. Preferably, the terminal block 28 is located toward the cooler end of the heater housing, i.e., near the air entry or upstream end. This location reduces the thermal stress on the terminal block and the associated electrical connections. The heater elements 10(*a*&*b*) are preferably arranged so that the terminal connector portions 32 and 34 which extend from an end of the mounted coil sections to the electrical terminal block are as short as possible. This aids in eliminating or reducing the need for supporting the connector portions. Therefore, any heater element mounted downstream of the first heater element, or farther from the terminal block, will preferably have a connector portion extending from the closest end of the closest coil sections on each side of the plate to the terminal block. In the preferred embodiment shown in the FIGURES, the downstream heater element has connector portions 34 that extend from about the middle of the terminal block side of the assembly to the terminal block 28.

In the dual heater element assembly of the preferred embodiment, the terminal block will preferably have three terminals 12, as shown in FIGS. 1&3. Two of the three terminals in the terminal block are preferably located in substantially the same location and arrangement as the two terminals in a standard single-stage electric heater assembly. Preferably, one of these two terminals will be common to both heater elements in the assembly. This enhances the interchangeability of the heater assembly with single-stage heater assemblies. The heat output from the assembly can be selectively controlled by energizing, through the designated terminals, none, one or more of the heater elements in the assembly.

The connector portions 32 and 34 of the heater element may be at least partially enclosed within an insulating member 36. This insulating member 36 may be formed from any type of material suitable for this purpose. Preferably, the insulating member 36 is tubular in shape and rigid. Preferably, the connector portions 34 of the heater element distant from the terminal block end of the housing will be at least partially enclosed within a tubular ceramic insulating member 36 to guard against inadvertent coil, plate or housing contact.

The support insulators 16 are preferably rotatably mounted within the plate 14. The support insulators are inserted into contoured openings 15 which extend through the plate 14. These contoured openings 15 are designed to receive and retain a support insulator while enabling the insulator to rotate in a predetermined direction. Preferably, all the contoured openings 15 are arranged so that the support insulators 16 rotate in the same rotational direction to complimentarily adjust for expansion of the heater elements. The complimentary rotation of these support insulators 16 reduces sag in the elements by preventing adjacent coils from rotating in opposite directions resulting in areas of exaggerated coil sag. These support insulators 16 are preferably formed from a ceramic containing material.

Figure 5:
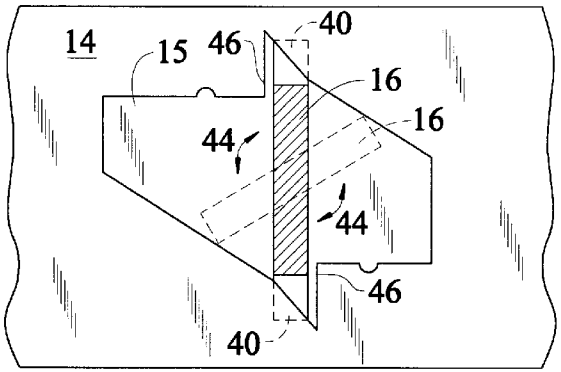
FIG. 5 is a sectional plan view taken through line 5—5 in FIG. 4.
Figure 4:
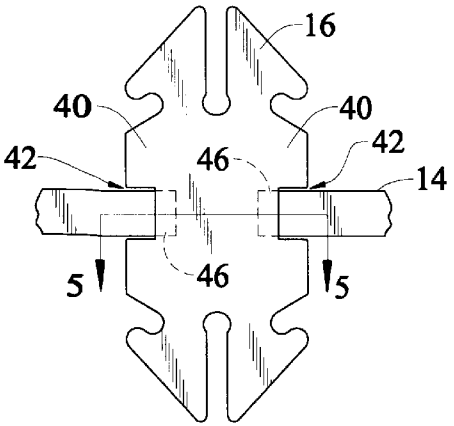
FIG. 4 is a sectional elevational view taken in the direction of line 4—4 in FIG. 1.

As best seen in FIGS. 4 and 5, insulator 16 includes shoulders 40 located on longitudinally opposite sides of a notch 42. To insert one of the insulators into opening 15 in support 14, the insulator is inserted through opening 15 in the orientation shown in the dashed lines in FIG. 5 such that notch 42 is aligned with plate 14 and rotated in the direction of arrows 44 until the insulator arrives in the position shown in the drawings and is stopped by contacting stopping surfaces 46 on plate 14. Shoulders 40 are located above and below plate 14, and because insulator 16 in this orientation is wider than opening 15, insulator 16 is substantially fixed in a direction perpendicular to plate 14.

EXAMPLE

A standard single-stage clothes dryer heater assembly designed with a housing and mounting sub-assembly, having adequate electrical and thermal safety clearances, for supporting and partially enclosing a 5400 watt heater element is re-designed to form a multi-stage heater assembly. The housing remains virtually intact. The mounting sub-assembly is re-designed to accommodate two heater elements composed of slightly finer gauge, higher resistance, and overall substantially greater length of resistive electric heater wire. The plate is slightly extended and the openings for the insulator supports are slightly modified to accommodate an additional row of heater element coil and additional supports, within each row, to adequately support the finer gauge wire. The contoured openings for the support insulators are re-arranged to minimize sag in the heater element by causing them all to rotate in the same direction.

The plate is further modified by removing portions of the plate to allow greater clearance for the connecting heater element portions that cross over from the mounted coils on one side of the plate to those on the other. The terminal block is extended and an additional terminal added without affecting the arrangement or location of the standard two terminals. The heater element coil arrangement is re-configured to minimize the length of the connector portions of the heater element. The connector portions of the downstream heater element are partially enclosed within a ceramic insulator tube to protect these portions from inadvertently contacting any other portions of the heater assembly.

The re-designed heater assembly has two separately controllable approximately 2700 watt heater elements with adequate support and safety clearances to provide a relatively equivalently durable heater assembly with a housing designed for a single stage heater assembly. This two-stage heater assembly can readily be incorporated into dryers designed for standard single-stage heater assemblies. With some minor electrical modifications to the dryers' control circuit, these dryers now have the ability to selectively regulate the heat output.

What is claimed is:

1. A multi-stage heater assembly comprising:

a first partially helically coiled electric heater element;

a second partially helically coiled electric heater element;

a terminal block;

said first heater element and said second heater element each including a first end and a second end, said first ends and second ends being connected to a single terminal block, wherein said first and second heater elements comprise a plurality of spaced-apart continuously connected substantially parallel coils;

insulator means for engaging and supporting said heater elements;

holding means for holding said insulator means;

housing means designed for airflow in a first direction for at least partially enclosing said heater elements and for supporting said holding means, said housing means having opposed sidewalls, each of said sidewalls having means for receiving an end of said holding means, whereby said heater elements, said insulator means, and said holding means are supported by said housing sidewalls; and, wherein said first and second heater elements are separately controllable and said second heater element is positioned downstream of said first heater element with respect to said air flow direction.

2. The heater assembly according to claim 1 wherein a connector portion of said heater element extending from a supported portion of said heater element to said terminal block is partially enclosed within a ceramic-containing insulator tube.

3. The heater assembly according to claim 1 wherein said insulator means comprises a plurality of support insulators.

4. The heater assembly according to claim 3 wherein said support insulators are rotatably mounted within said holding means.

5. The heater assembly according to claim 4 wherein said support insulators all rotate in the same direction.

6. A multi-stage open-coil electric heater assembly for heating a gas flowing through a duct from an upstream location to a downstream location comprising:

a housing having first and second spaced apart sidewalls, a connecting wall joining said first and second side walls, and an upstream end and a downstream end;

a terminal block attached to said housing;

a first set of support members connected between said first and second sidewalls;

a second set of support members connected between said first and second sidewalls and located downstream from said first set of support members;

a plurality of insulators attached to said support members;

a first partially helically coiled electric heating element comprising a plurality of spaced-apart continuously connected substantially parallel coils, having a first end and a second end, and being attached to said insulators on said first set of support members, said first end and said second end being electrically connected to said terminal block;

a second partially helically coiled electric heating element comprising a plurality of spaced-apart continuously connected substantially parallel coils, having a first end and a second end, and being attached to said insulators on said second set of support members, said first end and said second end being electrically connected to said terminal block; and, control means for independently controlling said first and second heating elements.

7. A heater assembly according to claim 1 wherein said first and second heating elements are parallel to said joining wall.

8. A heater assembly according to claim 7 wherein said second heating element comprises a helical portion and a linear portion, said linear portion extending perpendicularly to said support members between said terminal block and said helical portion.

9. A heater assembly according to claim 8 wherein said second heating element linear portion is partially enclosed within a ceramic insulator tube.

10. A heater assembly according to claim 7 wherein said first set of support members comprises three support members and wherein said second set of support members comprises three support members.

11. A heater assembly according to claim 10 wherein each one of said first heating element parallel coils is supported by one of said three support members of said first set.

12. A multi-stage open-coil electric heater assembly for heating a gas flowing through a duct from an upstream location to a downstream location comprising:

a housing having first and second spaced apart sidewalls and an upstream end and a downstream end;

a terminal block attached to said housing;

a first set of support members connected between said first and second sidewalls;

a second set of support members connected between said first and second sidewalls and located downstream from said first set of support members;

a plurality of insulators attached to said support members;

a first partially helically coiled electric heating element comprising a plurality of spaced-apart continuously connected substantially parallel coils attached to said insulators on said first set of support members, extending perpendicularly to at least one of said side walls, and being electrically connected to said terminal block;

a second partially helically coiled electric heating element, including a helical portion and a linear portion, attached to said insulators on said second set of support members and electrically connected to said terminal block, said linear portion extending perpendicularly to said support members between said terminal block and said helical portion and, control means for independently controlling said first and second heating elements.

* * * * *